US005346147A

United States Patent [19]

Ishikawa et al.

[11] Patent Number: 5,346,147

[45] Date of Patent: Sep. 13, 1994

[54] CRUSHING APPARATUS

[75] Inventors: Tsuyoshi Ishikawa; Akio Kinouchi, both of Tochigi, Japan

[73] Assignee: Mitsui Miike Kakouki Kabushiki Kaisha, Tokyo, Japan

[21] Appl. No.: 114,962

[22] Filed: Sep. 2, 1993

[30] Foreign Application Priority Data

Jan. 8, 1993 [JP] Japan ..... 5-000251[U]

[51] Int. Cl.[5] ..... B02C 17/00

[52] U.S. Cl. ..... 241/172; 241/74

[58] Field of Search ..... 241/73, 74, 171, 172, 241/173

[56] References Cited

U.S. PATENT DOCUMENTS 5,184,783 2/1993 Hockmeyer et al. ..... 241/172

FOREIGN PATENT DOCUMENTS 1335690 7/1963 France ..... 241/172

*Primary Examiner*—Douglas D. Watts

*Attorney, Agent, or Firm*—Oliff & Berridge

[57] ABSTRACT

A crushing apparatus crushes a supplied material into the form of a fine powder. The material is supplied into a crushing tank while disposing the crushing tank within the processing tank. The supplied material is crushed within the crushing tank and then is discharged to the interior of the processing tank through the axial flow pump member and an axial flow promoting member. During operation, the material is continuously circulated within the processing tank in a manner passing through the crushing tank, whereby crushing is performed in such circulating process. Since the axial flow pump member is provided at the lower portion of the crushing tank, the material in the inclined casing is guided axially downward to generate an axial flow when the inclined vane is rotated. A pumping effect is provided by the axial flow. The crushed material is sucked to the side of the inclined casing and then is emitted downward. When the axial flow promoting member is provided at the lower portion of the crushing tank, it is possible to strengthen the sucking force within the inclined casing. The material within the inclined casing is actively discharged by the rotation of the turbine vane positioned at a downward opening portion of the inclined casing.

8 Claims, 4 Drawing Sheets

CRUSHING APPARATUS

BACKGROUND OF THE INVENTION

1. Field of the Invention

This invention relates to crushing apparatus and, more particularly, relates to a crushing apparatus capable of obtaining a product in the form of a fine powder by agitating to crush a material to be processed which has been introduced into a crushing tank thereof.

2. Description of the Related Art

In general, a crushing apparatus is constructed such that an agitator is provided within a crushing tank having the shape of a longitudinal cylinder and, while feeding the material to be processed by means of a pump, the agitator is rotated to agitate the material to crush it.

Here, when the interior of a crushing apparatus is to be washed in the case of the crushing apparatus which crushes a material with media being present in the crushing tank thereof, it is necessary to take out the media in addition to dismantling of the crushing tank and pulling out of the agitator.

Therefore, not only it takes time as the washing operation is laborious but also the operating efficiency is greatly reduced because the crushing operation is suspended during the washing. Further, the recovery rate of the material to be processed is reduced, since the material adhered to respective portions is flushed.

To facilitate its washing, a type of crushing apparatus is provided in which a self-suction type crushing tank is inserted into a processing tank containing a slurry-like material to be processed so that the slurry-like material within the processing tank is circulated through the crushing tank.

In the crushing apparatus having a crushing tank of the type causing a circulation of a slurry-like material to be processed, however, there has been a problem that it can not be efficiently used when the viscosity of the material is relatively high.

SUMMARY OF THE INVENTION

Accordingly, it is an object of this invention to provide a crushing apparatus capable of performing crushing process in a circulating system of which cleaning is easy and also capable of improving the circulating efficiently of the material to be processed at the time of such crushing.

It is another object of this invention to provide a crushing apparatus capable of performing a sufficient crushing even when the viscosity of a slurry-like material to be processed is relatively high.

These and other objects, features and advantages of this invention will become clear from following description of the preferred embodiment when the same is read in conjunction with the accompanying drawings.

DESCRIPTION OF PREFERRED EMBODIMENT

Figure 1:
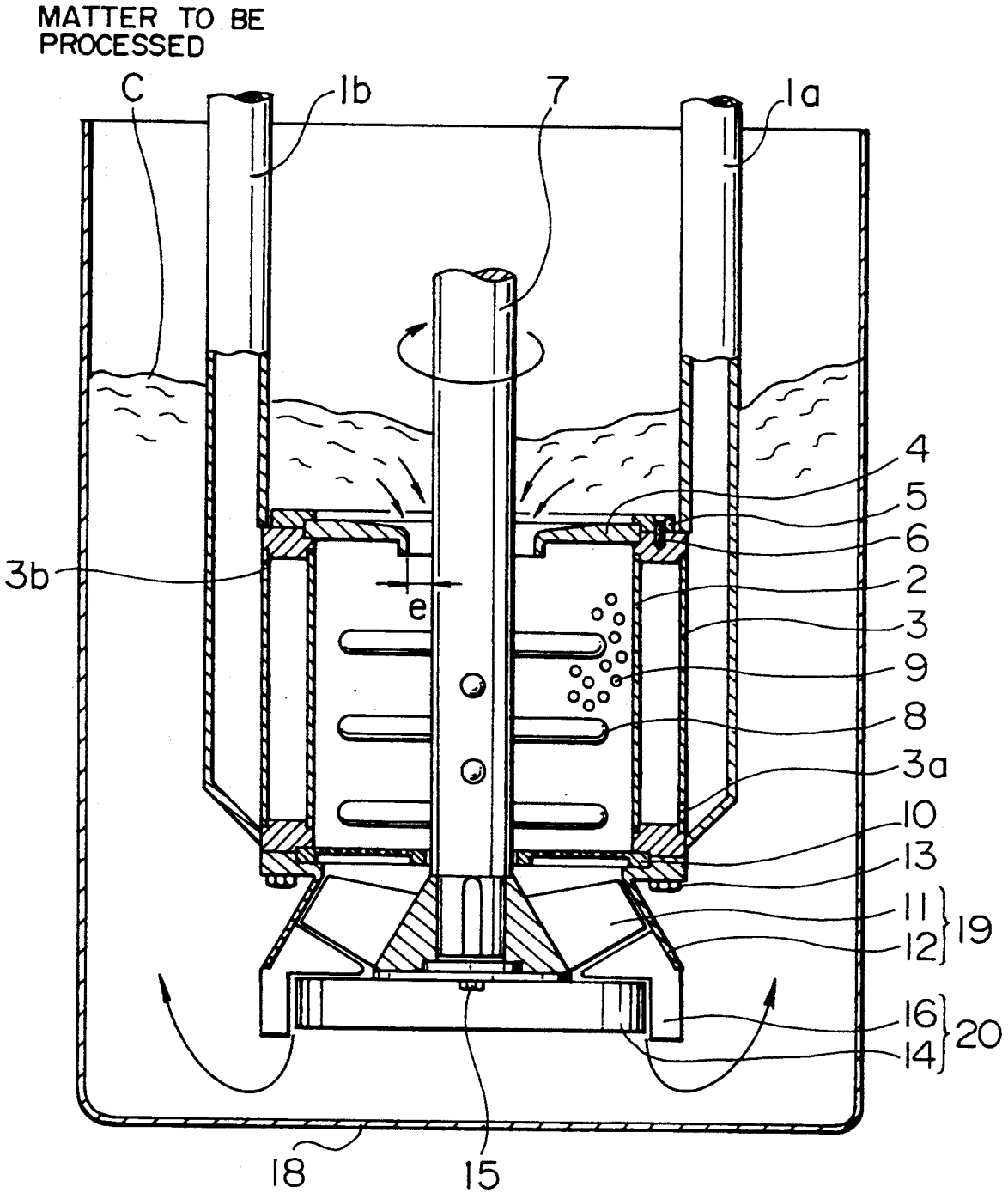
FIG. 1 is a schematic longitudinal sectional view showing an overall construction.
Figure 2:
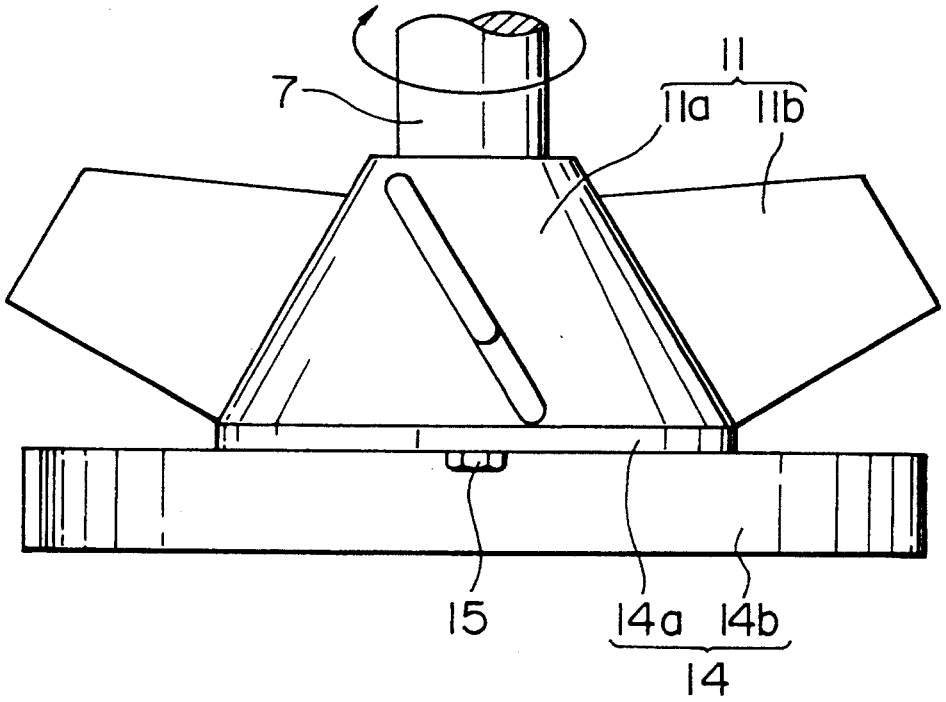
FIG. 2 is a view schematically showing certain portions.

In a crushing apparatus according to this invention, a crushing tank 2 in the form of a longitudinal cylinder has at its center portion a rotatable agitator shaft 7 provided in a vertical direction thereof, and arms 8 serving as the agitating member are provided on the agitator shaft 7.

An axial flow pump member 19 is provided on the lower portion of the crushing tank 2.

The axial flow pump member 19 is formed into a cylindrical shape of which diameter is increased toward the lower end thereof and has: an inclined casing 12 fixed via a separator 10 to the crushing tank 2 in a manner capable of communicating therewith; and inclined vanes 11 disposed within the inclined casing 12 in a manner driveably connected to the lower portion of the agitator shaft 7 and rotated so that each terminal end portion thereof travels along the inner peripheral surface of the inclined casing 12.

Further, an axial flow promoting member 20 is provided at the lower portion of the crushing tank 2 by way of the axial flow pump member 19.

The axial flow promoting member 20 is formed of: a plurality of guide plates 16 longitudinally attached to the inclined casing 12: and turbine vane 14 attached to the lower end portion of the agitator shaft 7 so as to be positioned at the portion of a downward opening of the inclined casing 12.

Further, the crushing tank 2 is inserted into a processing tank 18 containing a material C to be processed, together with the axial flow pump member 10 and the axial flow promoting member 20.

An axial flow is then caused of the material C within the inclined casing 12 by means of the pumping effect of the axial flow pump member 19, whereby the material C is circulated within the processing tank 18 through the crushing tank 2. At the time of such circulation, the in-process matter C discharged from the inclined casing 12 is actively sent forth outward in the radial direction thereof by means of operation of the axial flow promoting member 20, promoting the axial flow of the in-process matter C which has been generated at the axial flow pump member 19.

Further, the in-process matter C is crushed as it is agitated together with media 9 by means of the arms 8 in the crushing tank 2.

The processing tank 18 has the shape of a longitudinal cylinder having an upward opening.

The crushing tank 2 has the shape of a longitudinal cylinder, and a ring-like ceiling plate 4 is fixed by a bolt 6 to its upward opening portion in a manner pressed by a pressing plate 5 at the outer peripheral end portion thereof.

Further, a separator 10 formed by a screen or the like is fixed in a closed manner to its downward opening portion, so that a crushing chamber partitioned by the ceiling plate 4 and the separator 10 is formed within the crushing tank 2.

A jacket 3 is attached to the crushing tank 2 so as to cover the outside thereof at fixed intervals, thereby a flow passage is formed between the crushing tank 2 and the jacket 3. Supports 1*a*, 1*b* are connected to the jacket 3.

The supports 1*a*, 1*b* are each a pipe-like member capable of allowing a water flow the support 1*a* is provided to introduce a heat medium or a cooling medium into the flow passage between the crushing tank 2 and the jacket 3 and the support 1*b* is provided to discharge the introduced heat medium or cooling medium. The support 1*a* is connected at one end portion thereof in a manner capable of communication to an introduction port 3*a* formed on the outer peripheral surface of the jacket 3 and is connected to an external piping at the other end portion thereof.

Further, the support 1*b* is connected at one end portion thereof in a manner capable of communication to a discharging port 3*b* formed on the outer peripheral surface of the jacket 3 and is connected to an external piping at the other end portion thereof.

The other end portions of the two supports 1*a*, 1*b* are attached to an elevator apparatus (not shown) so that the crushing tank 2 is moved in an up and down direction via the supports 1*a*, 1*b* by means of driving of the elevator apparatus.

Further, the agitator shaft 7 to be rotated by an externally provided drive source is capable of being moved up and down together with the crushing tank 2 by an elevator apparatus (not shown) and is suspended downward in the center of the crushing apparatus 2 so that the lower end portion thereof penetrates through the separator 10.

The agitator shaft 7 is provided such that a ring-like gap "e" is formed between the agitator shaft 7 and the ceiling plate 4 which is provided at the upward opening portion of the crushing tank 2.

Thus, the interior of the crushing tank 2 and the interior of the processing tank 10 are in communication with each other through the gap "e", the gap "e" serving as the flow passage of the material C to be processed.

The arms 8 serving as the agitating member are attached to respective portions of the agitator shaft 7 which are positioned at the interior of the crushing chamber of the crushing tank 2. The arms 8 are each formed in the shape of a rod or wing and are attached thereto radially in the diametrical direction about the agitator shaft 7 and in a plurality of stages.

Figure 3:
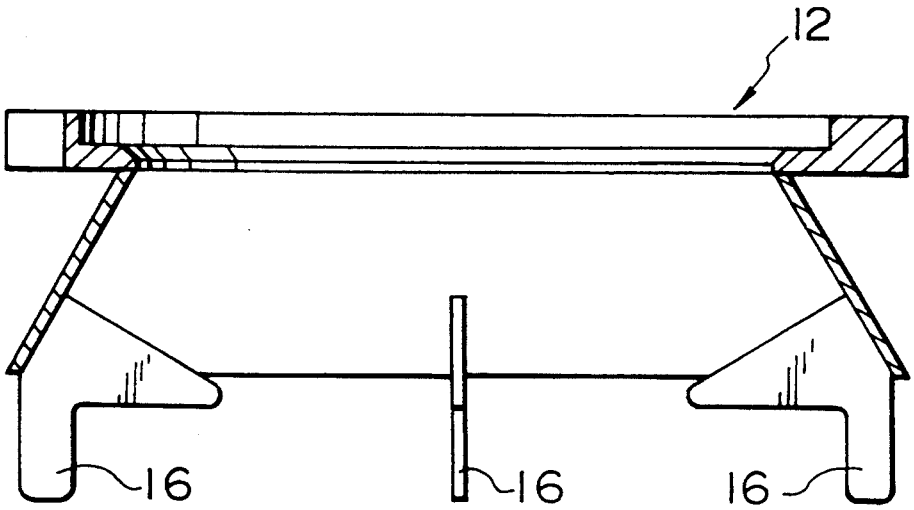
FIG. 3 is a sectional view showing an inclined casing.
Figure 4:
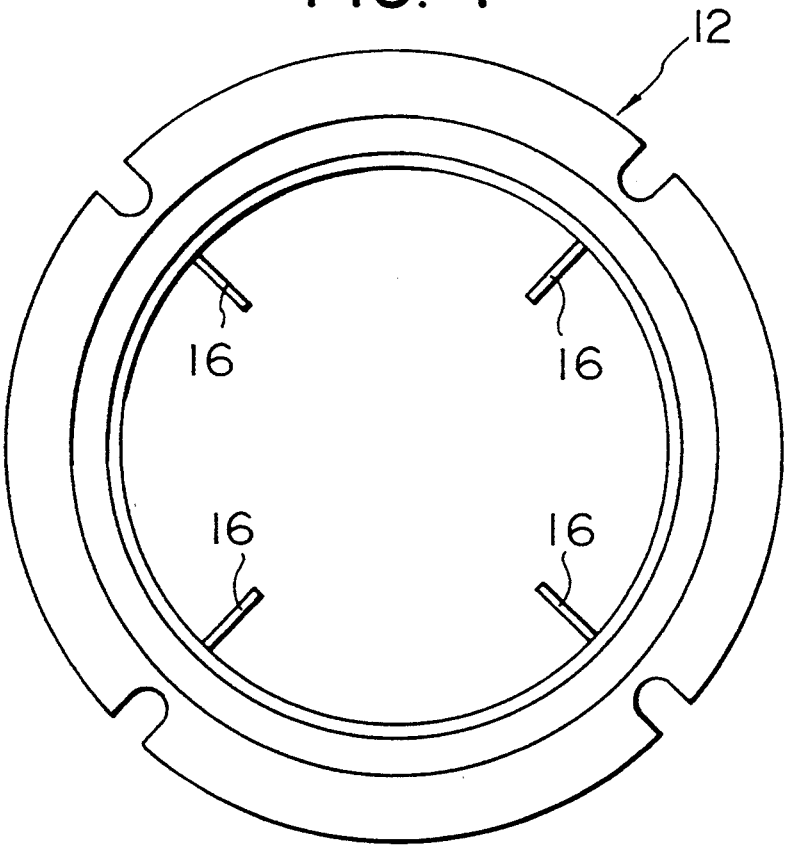
FIG. 4 is a top view of the casing as shown in FIG. 3.
Figure 5:
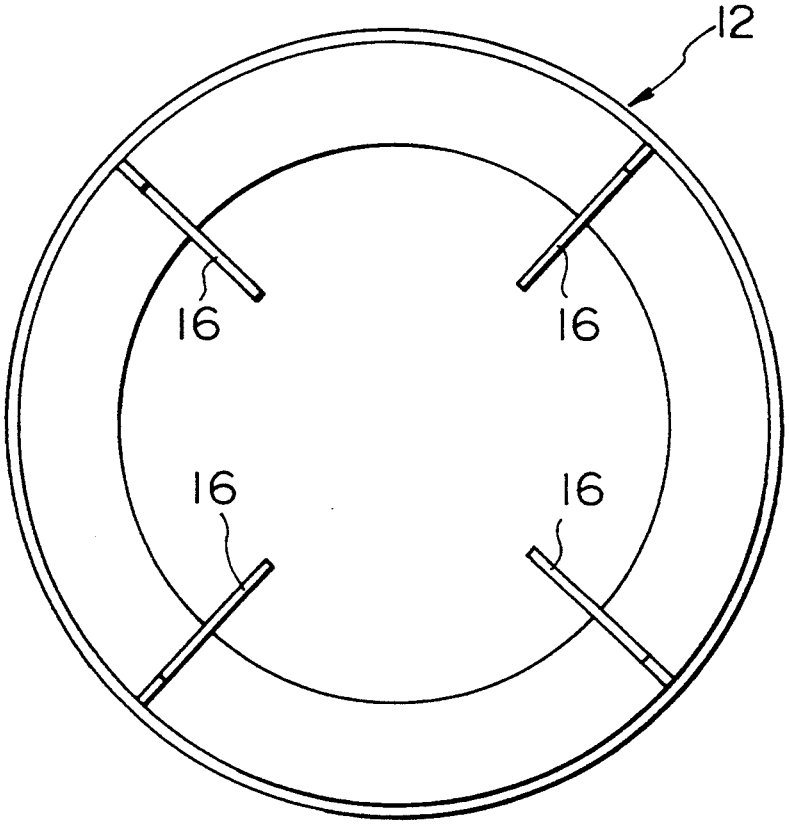
FIG. 5 is a bottom view of the casing as shown in FIG. 3.

An axial flow pump member 19 formed of the inclined casing 12 and the inclined vane 11 is provided at the lower portion of the crushing tank 2. As shown in FIGS. 3 to 5, the inclined casing 12 forming one side of the axial flow pump member 19 has the shape of a trapezoidal cone of which the diameter is increased toward the lower end thereof. It is fixed by a bolt 13 to the lower surface at the bottom portion of the crushing tank 2 in a manner capable of communicating with the crushing chamber with the separator 10 being placed between it and the crushing tank 2 and in a manner having its axial line coinciding with that of the crushing tank 2.

The inclined vane 11 forming the other part of the axial flow pump member 19 is constituted by: a fixing portion 11*a* fixed to the lower end portion of the agitator shaft 7 which is extended downward from the separator 10; and a plurality of vane portions 11*b* attached radially to the fixing portion 11*a*.

It is then mounted in the state where the fixing portion 11*a* and the vane portions 11*b* are positioned within the inclined casing 12.

The terminal end portion of each of the vane portions 11*b* is shaped correspondingly to the inner surface of the inclined casing 12 so that, when the vane portions 11*b* are rotated, the terminal ends thereof are rotated with a predetermined separation from the inclined casing 12.

An axial flow promoting member 20 is provided at the lower portion of the crushing tank 2 by way of the axial flow pump member 19.

The axial flow promoting member 20 is formed of guide plates 16 and turbine vane 14.

As shown in FIGS. 3 to 5, a plurality of guide plates 16 are equidistantly mounted on the lower end portion of the inclined casing 12. The guide plates 16 are positioned at the lower side of the vane portions 11*b* of the inclined vane 11.

Figure 6:
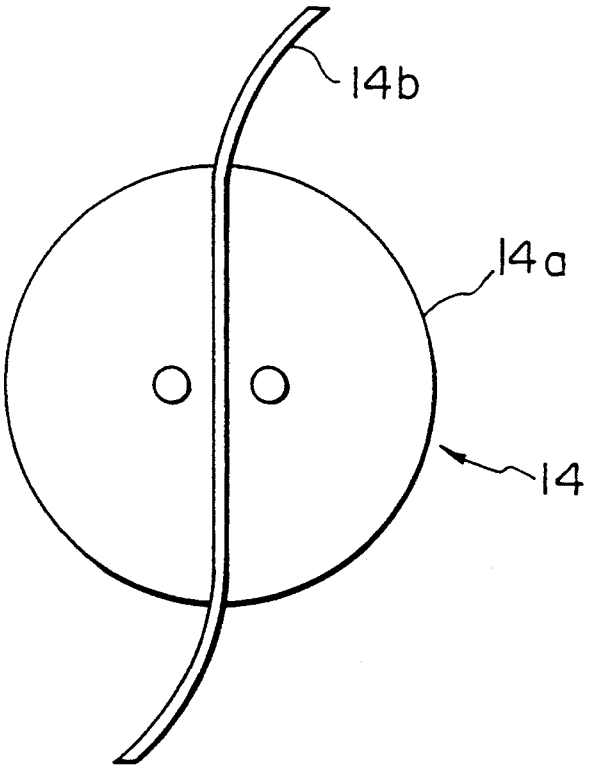
FIG. 6 is a bottom view of turbine vanes.
Figure 7:
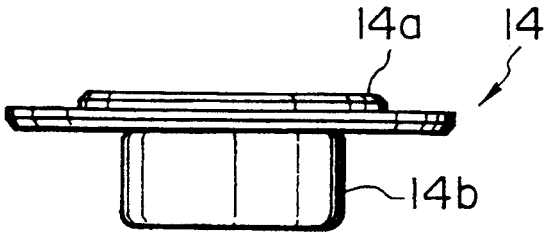
FIG. 7 is a front view of the turbine vane.
Figure 8:
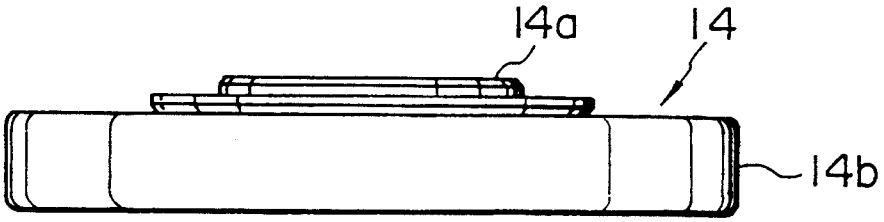
FIG. 8 is a side view of the turbine vane.

The turbine vane 14 is, as shown in FIGS. 6 to 8, constituted by: an attaching portion 14*a* to be mounted on the lower end portion of the agitator shaft 7 via the inclined vane 11; and vane portions 14*b* attached to the attaching portion 14*a* so as to have the two equal portions extended outward.

The turbine vane 14 is provided at the lower end portion of the agitator shaft 7 with the vane portion 14*b* being disposed at the downward opening portion of the inclined casing 12. To reduce resistance at the time of rotation, the terminal end of each vane portion 14*b* is preferably positioned more backward than the other portions thereof in the direction of the rotation.

It should be noted that a large number of media 9 are contained in the crushing chamber of the crushing tank 2 in a manner formed as having a size incapable of passing through the separator 10. When the arms 8 are rotated, the in-process matter C in the crushing chamber is agitated together with the media 9 so as to be crushed. Thereby, a more efficient crushing processing becomes possible.

The operation of the one described above will now be described.

First, a slurry-like matter C which is the material is introduced into the processing tank 18.

The crushing tank 2 and the agitator shaft 7 are then moved downward from an overhead position to be inserted into the processing tank 18 by means of drive of an elevator apparatus (not shown), and an external drive source is started to rotate the agitator shaft 7.

At this time, since an opening portion of the crushing tank 2 is provided at the upper portion thereof, it is necessary to supply the matter C into the processing tank 18 to the extent that the crushing tank 2 is completely plunged into the in-process matter C when it is positioned within the processing tank 18.

The in-process matter C existing above the ceiling plate 4 of the crushing tank 2 at the interior of the processing tank 18 is to be introduced into the crushing chamber of the crushing tank 2 from the flow passage formed at the ring-like gap "e" between the ceiling plate 4 and the agitator shaft 7.

In the crushing chamber, the in-process matter C is agitated together with the media 9 by the arms 8 which are rotated by the rotation of the agitator shaft 7, and, at this time, the in-process matter C is crushed by impact force and shearing force caused between the in-process matter C and the arms 8 as well as the media 9.

Then, the in-process matter C crushed in the crushing chamber C passes through the separator 10 by means of the suction force of the axial flow pump member 19 provided at the lower portion of the crushing tank 2 and then discharged to the interior of the processing tank 18 from the downward opening of the inclined casing 12 by way of the axial flow promoting member 20.

In other words, since the inclined vane 11 of the axial flow pump member 19 is adapted such that it is rotated together with the agitator shaft 7 to discharge radially outward the in-process matter C existing between the vane portions 11*b*, 11*b*, a negative pressure is caused at the axial portion thereof to generate a suction force.

Further, since the inclined casing 12 surrounding the outer periphery of the inclined vane 11 has the shape of a cylinder of which the diameter is increased toward its lower end and the inner surface thereof is formed as an inclined surface, the in-process matter C discharged radially outwardly at the inclined vane 11 is caused to move downward along the inner surface of the inclined casing 12.

Thereby, a flow in the axial direction (axial flow) may be generated to suck the in-process matter C within the crushing chamber to the inside of the inclined casing 12.

Further, the axial flow generated by the suction force of the axial flow pump member 19 is promoted by a promoting effect of the axial flow promoting member 20 which is formed by the guide plates 16 and the turbine vane 14.

Since the guide plates 16 as described are attached in their vertical position to the lower end portion of the inclined casing 12, they prevent a perimetrical flow of the in-process matter C by the inclined vane 11 at the inside of the inclined casing 12 and guide it in the axial direction.

Further, since the turbine vane 14 is rotated together with the agitator shaft 7, a delivery pressure is obtained, by which the in-process matter C existing between the vane portions 14*b* is emitted radially outwardly to actively discharge the in-process matter C within the inclined casing 12.

Therefore, the axial flow generated by the guide plates 16 and the inclined casing 12 is promoted by the delivery pressure which is obtained at the turbine vane 14, whereby the in-process matter C at the interior of the inclined casing 12 is effectively discharged from the downward opening portion.

The operation as described is performed for a predetermined time period. The entire amount of the matter C is circulated within the processing tank 18 through the crushing tank 2, during which process crushing is carried on as agitation/crushing is continuously performed in the crushing chamber. As a result, the crushed matter of a predetermined particle size may be obtained.

It should be noted that, during the operation as described, a heating medium or cooling medium is supplied from the support la to the flow passage formed between the crushing tank 2 and the jacket 3 and the heating medium or the cooling medium supplied to the interior of the flow passage is discharged to the support 1*b*. Thus, the heating medium or the cooling medium is circulated through the passage within the jacket 3.

Thereby, the in-process matter C in the crushing tank 2 and the in-process matter C in the processing tank 18 are heated or cooled. The in-process matter C is, as a result, kept at a suitable temperature at all times, whereby a uniformed crushing process and an improved efficiency thereof may be achieved.

The crushing apparatus as described is able to improve the circulating efficiency of the in-process matter C within the processing tank 18.

Since the axial flow promoting member 20 is provided at the lower portion of the crushing tank 2 by way of the axial flow pump member 19, a flow of the in-process matter C in the axial direction (axial flow) is generated by the axial flow pump member 19. Also, since the axial flow of the in-process matter C is promoted by the axial flow promoting member 20, it is possible to increase discharge amount per unit time of the in-process matter C crushed in the crushing chamber of the crushing tank 2.

That is, since the axial flow pump member 19 formed of the inclined vane 11 and the inclined casing 12 is provided at the lower portion of the crushing tank 2, occurrence of the axial flow is promoted.

In other words, when the in-process matter C existing between the vane portions 11*b* is emitted radially outward by the rotation of the inclined vane 11, a suction force is generated at the axial portion of the inclined vane 11 and the emitted matter C is guided downward in the axial direction due to the inclination of the inner surface of the inclined casing 12. Thus, an axial flow of the in-process matter C tends to occur.

Moreover, since the axial flow promoting member 20 formed of the guide plates 16 and the turbine vane 14 is provided at the lower portion of the axial flow pump member 19, the axial flow generated at the axial flow pump member 19 is further promoted.

In other words, the axial flow is insufficient by merely providing a vane member connected to the agitator shaft 7 at the lower portion of the crushing tank 2. However, since the rotating movement of the in-process matter C within the inclined casing 12 is once stopped and at the same time such in-process matter C is guided downward along the axial line, the axial flow is promoted.

In addition, the in-process matter C existing between the vane portions 14*b* is emitted radially outward at the downward opening of the inclined casing 12 by the rotation of the turbine vane 14 which forms the axial flow promoting member 20, thereby increasing the delivery per unit time of the in-process matter C within the inclined casing 12. Further, since the vane portion 14*b* of the turbine vane 14 at the time of its rotation also has the effect of agitating the in-process matter C existing at the bottom portion of the processing tank 18, it takes a role in uniforming of the interior of the processing tank 18.

As a result of what has been described, since a large sucking force and discharging force may be obtained within the inclined casing 12 due to a synergistic effect of the axial flow pump member 19 and the axial flow promoting member 20, the flow amount of the in-process matter C discharged from the downward opening portion of the inclined casing 12 is increased. Accordingly, the circulating amount of the in-process matter C passing through the crushing chamber is increased and, as a result, the in-process matter C within the processing tank 18 may be continuously kept in its homogeneous state.

Therefore, even when the slurry-like matter C to be introduced into the processing tank 18 has a relatively high viscosity, its circulation in a large amount within the processing tank 18 is possible so that crushing processing may be performed sufficiently and efficiently.

Further, an after-processing may be easily performed with the crushing apparatus as described.

That is, after terminating the crushing processing, by emptying the crushing tank 2 and then operating it briefly, the in-process matter C remaining within the crushing tank 2 is easily caused to fall down. Thus, a substantially complete recovery of the matter C is possible.

Further, when washing the crushing tank 2, by introducing a solvent or the like into the processing tank 18 and by operating it in a similar manner as in the crushing, the interior of the crushing tank 2 is completely cleaned. Accordingly, since dismantling of the crushing tank 2 is not necessary, its ability to be cleaned may be improved.

Further, the above described crushing apparatus may be constructed to have a simple structure.

In particular, the jacket 3 is provided at the outer periphery of the crushing tank 2 to form a flow passage of a heating medium or a cooling medium for heating or cooling the in-process matter C, and the crushing tank 2 is plunged into the in-process matter C within the processing tank 18 —the heating medium or the cooling medium flowing through the interior of the jacket 3 has an effect on both the in-process matter C within the crushing tank 2 and the in-process matter C in the processing tank 18.

Thereby, it is not necessary to provide separate jackets 3 respectively for the crushing tank 2 and for the processing tank 18. Further, since the support 1 from which the crushing tank 2 is suspended is adapted to serve also as a piping for flowing of the heating medium or the cooling medium, such piping as a separate member may be eliminated. Thus, simplification of the structure may be achieved while securing the quality of products.

It should be noted that, when a plurality of processing tanks 18 are provided and they are made movable by providing wheels at the bottom portion of each of them, operation may be continued by moving the processing tanks 18 successively every time when a crushing processing is terminated, making possible a continuous operation.

In general, resistance (pressure loss) at the time when the in-process matter C passes through the crushing chamber and the separator 10 becomes very large. It is thus important to cause a large suction force or a large delivery pressure acting upon at the lower portion of the crushing tank 2, in order to circulate, particularly, a large amount of a high viscosity matter C within the processing tank 18.

In the present embodiment, the axial flow pump member 19 formed of the inclined vane 11 and the inclined casing 12 and the axial flow promoting member 20 formed of the guide plates 16 and the turbine vane 14 are provided at the lower portion of the crushing tank 2—a large suction force is acted upon at the lower portion of the crushing tank 2 so that circulation in a large amount within the processing tank 18 is possible even when the viscosity of the in-process matter C is high.

Accordingly, since the axial flow pump member 19 is provided at the lower portion of the crushing tank 2, an axial flow may be easily generated at the lower portion of the crushing tank 2 whereby a suction force is securely obtained. It is thus possible to increase the circulating amount of the in-process matter C which circulates within the processing tank 18 in a manner passing through the crushing tank 2.

Thereby, the in-process matter C within the processing tank 18 may be kept in its homogeneous state to obtain a high quality product.

Further, the axial flow promoting member 20 is provided at the lower portion of the crushing tank 2 by way of the axial flow pump member 19. Thus, the suction force obtained at the axial flow pump member 19 may be further strengthened to further improve the circulating efficiency of the in-process matter.

Accordingly, a sufficient circulation is possible, particularly, even when a high viscosity material is to be processed. As a result, a high quality product with a sharp and uniform size distribution may be obtained.

Furthermore, the axial flow pump member and the axial flow promoting member have a simple structure, respectively, and their washing after a crushing process may be performed easily and in a short time period. It is possible to improve the utilizing efficiency of the present machinery.

What is claimed is:

1. A crushing apparatus for crushing a supplied material into the form of a fine powder, said crushing apparatus comprising:

a processing tank to which the material is supplied;

a crushing tank shaped into a longitudinal cylinder, capable of being moved up and down by an elevator apparatus so as to be positioned within said processing tank;

an agitator shaft rotatable by means of a drive source, positioned in a vertical direction at a center portion of the crushing tank, and an agitating member attached to the agitator shaft to be rotated together therewith; and an axial flow pump member including: an inclined casing provided at a lower portion of said crushing tank, having a cylindrical shape of which diameter is increased toward the lower end and fixed to said crushing tank in a manner capable of communicating therewith; and an inclined vane driveably connected to a lower portion of said agitator shaft so as to be positioned within said inclined casing;

an axial flow promoting member provided at the lower portion of said crushing tank by way of said axial flow pump member, said axial flow promoting member including guide plates attached to the lower portion of said inclined casing and turbine vanes attached to the lower portion of said agitator shaft; and wherein the material is supplied into the crushing tank while disposing said crushing tank within the processing tank, the material being circulated between an interior of the crushing tank and an interior of said processing tank while being agitated to be crushed by said agitating member within the crushing tank, whereby an axial flow flowing downward is generated within the crushing tank by said axial flow pump member.

2. A crushing apparatus according to claim 1, further comprising a separator provided at the lower portion of said crushing tank, and wherein media having a size incapable of passing through said separator are contained in the crushing tank.

3. A crushing apparatus according to claim 1, wherein said crushing tank is capable of being moved up and down by way of support so as to be positioned at the interior of said processing tank.

4. A crushing apparatus for crushing a supplied material into the form of a fine powder, said crushing apparatus comprising:

a processing tank to which the material is supplied;

a crushing tank shaped into a longitudinal cylinder, capable of being moved up and down by an elevator apparatus so as to be positioned within said processing tank;

an agitator shaft rotatable by means of a drive source, positioned in the vertical direction at the center portion of the crushing tank, and an agitating member attached to the agitator shaft to be rotated together therewith;

an axial flow pump member including: an inclined casing provided at the lower portion of said crushing tank, having a cylindrical shape of which diameter is increased toward the lower end thereof and fixed to said crushing tank in a manner capable of communicating therewith; and an inclined vane driveably connected to the lower portion of said agitator shaft so as to be positioned within said inclined casing; and an axial flow promoting member including: guide plates provided at the lower portion of said crushing tank by way of said axial flow pump member and attached to the lower end portion of said inclined casing; and turbine vane attached to the lower end portion of said agitator shaft; and wherein the material is supplied into the crushing tank while disposing said crushing tank within the processing tank, the material being circulated between the interior of the crushing tank and the interior of said processing tank while being agitated to be crushed by said agitating member within the crushing tank, whereby an axial flow flowing downward is generated within the crushing tank by said axial flow pump member and the axial flow generated by the axial flow pump member is promoted by said axial flow promoting member.

5. A crushing apparatus according to claim 4, further comprising a separator provided at the lower surface of said crushing tank, and wherein media having a size incapable of passing through said separator are contained in the crushing tank.

6. A crushing apparatus according to claim 4, wherein said crushing tank is capable of being moved up and down by way of a support so as to be positioned at the interior of said processing tank.

7. A crushing apparatus according to claim 4, wherein said crushing tank is capable of being moved up and down by way of two pipe-like supports so as to be positioned at the interior of said processing tank, and wherein the two supports being in communication with each other through a jacket formed on the outer peripheral surface of the crushing tank whereby a heating medium or a cooling medium being introduced through the two supports.

8. A crushing apparatus for crushing a supplied material into the form of a fine powder, said crushing apparatus comprising:

a processing tank to which the material is supplied;

a crushing tank shaped into a longitudinal cylinder, capable of being moved up and down by an elevator apparatus so as to be positioned within said processing tank;

an agitator shaft rotatable by means of a drive source, positioned in the vertical direction at the center portion of the crushing tank, and an agitating member attached to the agitator shaft to be rotated together therewith; and an axial flow pump member including: an inclined casing provided at the lower portion of said crushing tank, having a cylindrical shape of which diameter is increased toward the lower end thereof and fixed to said crushing tank in a manner capable of communicating therewith; and an inclined vane driveably connected to the lower portion of said agitator shaft so as to be positioned within said inclined casing; and wherein the material is supplied into the crushing tank while disposing said crushing tank within the processing tank, the material being circulated between the interior of the crushing tank and the interior of said processing tank while being agitated to be crushed by said agitating member within the crushing tank, whereby an axial flow flowing downward is generated within the crushing tank by said axial flow pump member, and said crushing tank is capable of being moved up and down by way of two pipe-like supports so as to be positioned at the interior of said processing tank, and wherein the two supports being in communication with each other through a jacket formed on the outer peripheral surface of the crushing tank whereby a heating medium or a cooling medium being introduced through the two supports.

* * * * *

UNITED STATES PATENT AND TRADEMARK OFFICE

CERTIFICATE OF CORRECTION

PATENT NO. : 5,346,147
DATED : September 13, 1994
INVENTOR(S) : Tsuyoshi ISHIKAWA et al.

It is certified that error appears in the above-indentified patent and that said Letters Patent is hereby corrected as shown below:

On the title page, item

[73] Assignee: Change "MITSUI MIIKE KAKOUKI KABUSHIKI KAISHA" to --MITSUI MINING COMPANY--.

Signed and Sealed this

Twenty-first Day of February, 1995

*Attest:*

Bruce Lehman

BRUCE LEHMAN

*Attesting Officer*

*Commissioner of Patents and Trademarks*